US006325533B1

(12) United States Patent
Kelley

(10) Patent No.: US 6,325,533 B1
(45) Date of Patent: Dec. 4, 2001

(54) APPARATUS FOR STORING CONTAINERS OF MIXTURES FOR PREVENTING SEPARATION OR CRYSTALLIZATION THEREOF

(75) Inventor: John Falk Kelley, Mahopac, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/433,290

(22) Filed: Nov. 3, 1999

(51) Int. Cl.[7] ..... B01F 9/02

(52) U.S. Cl. ..... 366/219; 366/220; 366/601

(58) Field of Search ..... 366/219, 220, 366/225, 228, 229, 230, 231, 233, 235, 601, 142, 144, 197

(56) References Cited

U.S. PATENT DOCUMENTS

| | | | | |
|---|---|---|---|---|
| 951,978 | * | 3/1910 | Wilson, Jr. | 366/235 |
| 1,445,488 | * | 2/1923 | Clark | 366/233 |
| 1,631,999 | * | 6/1927 | Chandler | 366/233 |
| 1,940,492 | * | 12/1933 | Gale | 366/233 |
| 2,004,222 | * | 6/1935 | Schmohl | 366/233 |
| 2,041,318 | * | 5/1936 | Berger | 366/230 |
| 2,979,951 | * | 4/1961 | Pircon | 366/231 |
| 3,181,842 | * | 5/1965 | Eckert | 366/233 |
| 3,438,353 | * | 4/1969 | Pellegrini | 366/233 |
| 3,468,522 | * | 9/1969 | Bonvgne | 366/233 |
| 3,764,112 | * | 10/1973 | Jelley | 366/233 |
| 3,816,999 | * | 6/1974 | Dreher | 366/233 |
| 4,056,260 | * | 11/1977 | David | 366/144 |
| 4,139,992 | * | 2/1979 | Fraser | 366/235 |
| 4,350,430 | * | 9/1982 | Johnson | 366/233 |
| 4,669,274 | * | 6/1987 | Huang | 366/233 |
| 4,722,198 | * | 2/1988 | Huang | 366/233 |
| 4,785,728 | * | 11/1988 | Miyata et al. | 366/233 |
| 4,813,243 | * | 3/1989 | Woods et al. | 366/235 |
| 5,201,265 | * | 4/1993 | Matsui | 366/144 |
| 5,299,864 | * | 4/1994 | Reynols et al. | 366/235 |
| 5,407,809 | * | 4/1995 | Finn | 366/228 |

FOREIGN PATENT DOCUMENTS

| | | | | |
|---|---|---|---|---|
| 62-294031 | * | 12/1987 | (JP) | 366/233 |
| 3-27261 | * | 2/1991 | (JP) | 366/233 |

* cited by examiner

*Primary Examiner*—Tony G. Soohoo
(74) *Attorney, Agent, or Firm*—Stephen C. Kaufman, Esq; McGinn & Gibb, PLLC

(57) ABSTRACT

A system for storing a container containing a mixture therein having blended constituents, includes a frame, a drive roller mounted on the frame, and a passive roller mounted on the frame, a container being received on an outer periphery of the drive roller and the passive roller. The drive roller rotates the container such that the mixture held in the container is maintained blended.

10 Claims, 3 Drawing Sheets

APPARATUS FOR STORING CONTAINERS OF MIXTURES FOR PREVENTING SEPARATION OR CRYSTALLIZATION THEREOF

BACKGROUND OF THE INVENTION

1. Field of the Invention

The present invention generally relates to compositions stored in a container such as a jar or can and more specifically to an apparatus for preventing separation or crystallization of the stored compositions.

2. Description of the Related Art

Some compositions separate when stored in ajar or can (e.g., natural peanut butter, paint, glue, or some chemical laboratory compounds, etc.) while other compositions crystallize (e.g., honey, etc.). These mixtures may already be separated or crystallized at the time of purchase and re-blending these mixtures is not always simple, and in some cases makes the mixture difficult to use, if not unusable.

Conventional systems exist such as shakers which can be used to re-blend the mixtures at the time of use, but such shakers are cumbersome, noisy, expensive, and are used only after the mixture's constituents have become separated. Thus, such shakers represent a post-hoc fix, and do not continuously keep the mixture blended. Other solutions are to use motorized blenders and food processors, but such machines are messy and expensive.

SUMMARY OF THE INVENTION

In view of the foregoing and other problems of the conventional methods and systems, an object of the present invention to provide a structure for continuously keeping a mixture blended in a container.

Another object of the invention is to provide a device which is inexpensive, available to the household consumer, not cumbersome, messy or noisy to the user, and which is used to continually keep a mixture blended in a container.

In a first aspect of the present invention, a system for storing a container containing a mixture therein having blended constituents, includes a frame, a drive roller mounted on the frame, and a passive roller mounted on said frame, a container being received on an outer periphery of the drive roller and the passive roller, wherein the drive roller rotates the container such that the mixture held in the container is maintained blended.

With the unique and unobvious features of the present invention, a compact, quiet, and easy-to-use structure is provided for continuously keeping a mixture blended in a container.

Additionally, the present invention is easy-to-use (e.g., can use common household alternating current (AC)), and is immediately available.

BRIEF DESCRIPTION OF THE DRAWINGS

The foregoing and other objects, aspects and advantages will be better understood from the following detailed description of preferred embodiments of the invention with reference to the drawings, in which.

DETAILED DESCRIPTION OF REFERRED EMBODIMENTS OF THE INVENTION

Figure 1:
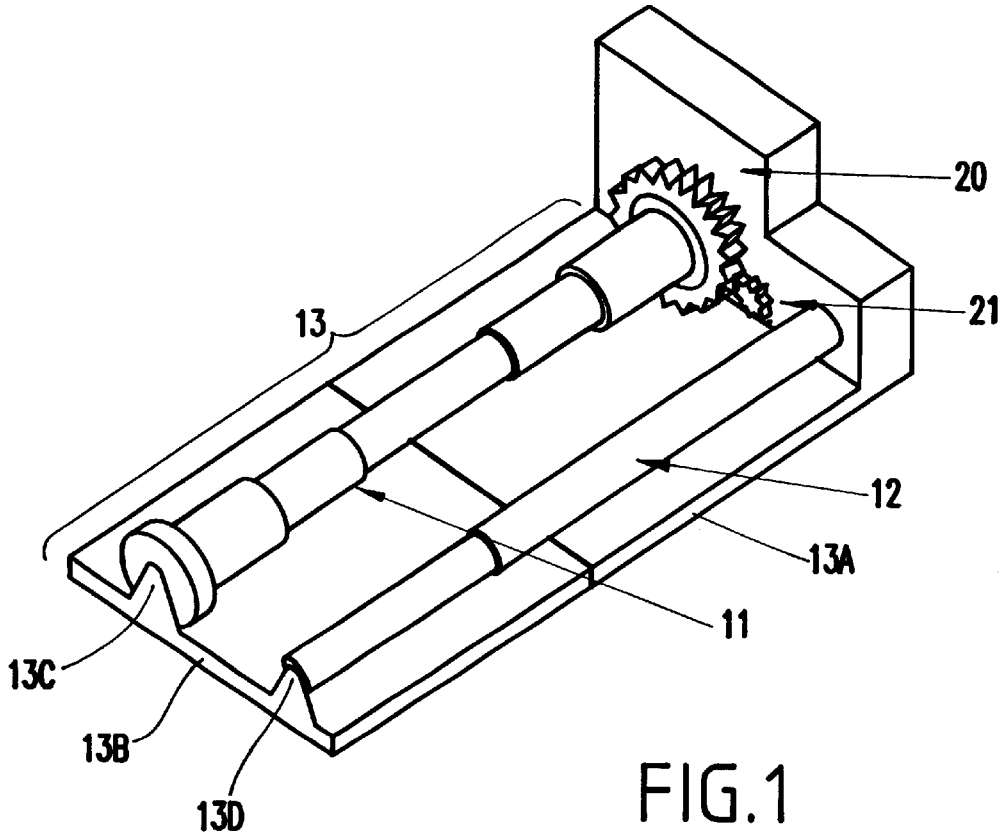
FIG. 1 is a schematic diagram of a single-can roller.

Referring now to the drawings, and more particularly to FIG. 1, a most basic configuration of a preferred embodiment of the present invention is shown.

In FIG. 1, rollers 11, 12 are mounted on a fame 13. Such a frame may have a fixed size so as to accommodate containers (e.g., jars, cans, etc.) of different heights up to a predetermined size.

Alternatively, as shown in FIG. 1, the frame and the rollers 11, 12 may be "telescoped" to varying lengths to accommodate containers of different sizes. Specifically, the frame 13 may be formed of first and second portions 13A, 13B. Portion 13A may be stationary and portion 13B may be adjusted from stationary portion 13A to accommodate containers of different sizes.

Similarly, the rollers 11, 12 may be formed of a fixed (stationary) portion and an adjustable portion. The ends of the adjustable portions of the rollers 11, 12, are designed to fit into prongs 13C, 13D integrally formed with the adjustable portion 13B of the frame. The "telescoping" capability allows accommodation of a plurality of containers of different sizes. Further, the telescoping of the driver roller and passive roller is preferably performed so that the unit can be made approximately the same depth (e.g., length) of the container.

Additional telescoping steps of the drive roller could be used to accommodate very short cans. As mentioned above, the base (frame) is also telescoped so that it lengthens and shortens along with the rollers. The drive roller has gradation at its ends to prevent the can from rolling off the mechanism. While not shown, a distance between the drive roller and passive roller could be selectively adjusted to accommodate cans having different diameters, thereby providing increased stability.

In operation, the passive roller 12 holds the container in place while the drive roller 11 rotates, thereby rolling the can and consequently the mixture held in the container. Such rotation of the container prevents separation of the mixture, thereby extending its utility and shelf life.

Thus, one or more drone rollers may be used to roll a few cans or jars in a pyramid.

Further, a clockwork 20 and a drive gear 21 are provided for controlling the drive roller 11 that rotates a cylindrical container (not illustrated). Clockwork 20 preferably comprises a plurality of intermeshing gears for selectively coupling to the drive gear 21. Preferably, the clockwork 20 is driven by a direct current (DC) source such as a battery (e.g., lithium, nickel-cadmium, etc.) so as to provide portability of the device. Of course, an alternating current (AC) source also may be employed.

Another option is to use a commercially available atmospheric clock mechanism. Such mechanisms are reliable and inexpensive, and include a barometer. As the barometric pressure changes, the containers are selectively and suitably rolled. Further, the drive roller could be interfaced with a temperature gauge (e.g., a thermostat or the like) such that temperature changes could trigger the operation of the drive roller/clockwork. Any clockwork may be employed which causes rotation of stored mixtures to prevent settling or crystallization. Regardless of the clockwork used, preferably the clockwork is lightweight and as small as possible.

The clockwork may be programmed to rotate the container(s) a predetermined number of times per day or may be in an ON state continuously, thereby rotating the container continuously but at a slow rate of rotation so as to prevent separation.

Alternatively to an affirmative action being required by the operator such as turning a switch or actuating a button to activate the clockwork, the clockwork 20 may be automatically actuated by changes in temperature, atmospheric pressure, etc., as mentioned above.

Further, as mentioned above, the container may be rotated slowly (e.g., possibly one rotation per day), or at an adjustable rate, depending on how separated the mixture is and how long the mixture will be stored before use. Such programmed rates of rotations may be made by a processor provided in the frame or coupled externally thereto.

Figure 2:
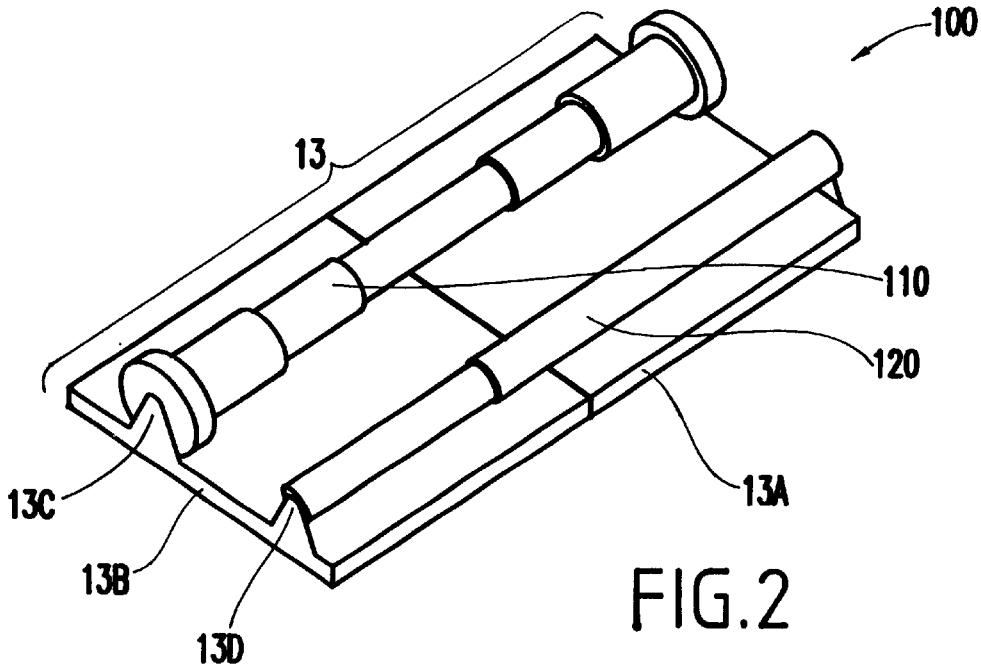
FIG. 2 is a schematic diagram of a drone unit for use with the single-can roller of FIG. 1.

FIG. 2 illustrates a drone unit 100 (e.g., substantially the same as in FIG. 1, but without a drive gear/clockwork 20 of FIG. 1) which has a drive roller 110 and a passive roller 120. The passive roller 120 is stationary and is for receiving a container (not illustrated) thereon. Preferably, the container is a cylindrical container such as a can, jar, etc. More specifically, the container is received by both the drive roller 110 and the passive roller 120. Preferably, the drive roller 110 and the passive roller 120 have a suitable diameter for accommodating the containers therebetween. Preferably, a material such as rubber, elastomer, etc. is provided on at least one of the rollers 110 and 120 for gripping the containers so they do not slip while rotating.

It is noted that a single drive unit could be employed in the middle between two drone units. That is, the drive unit would be situated to receive a drone unit on either side thereof. A plurality of such drone units would be useful for turning a pyramid of containers. Alternatively, a plurality of containers could be provided in line. Further, it is noted that once a certain weight of the containers is reached, a bearing may be advantageously used by the invention.

Second Embodiment

Figure 3:
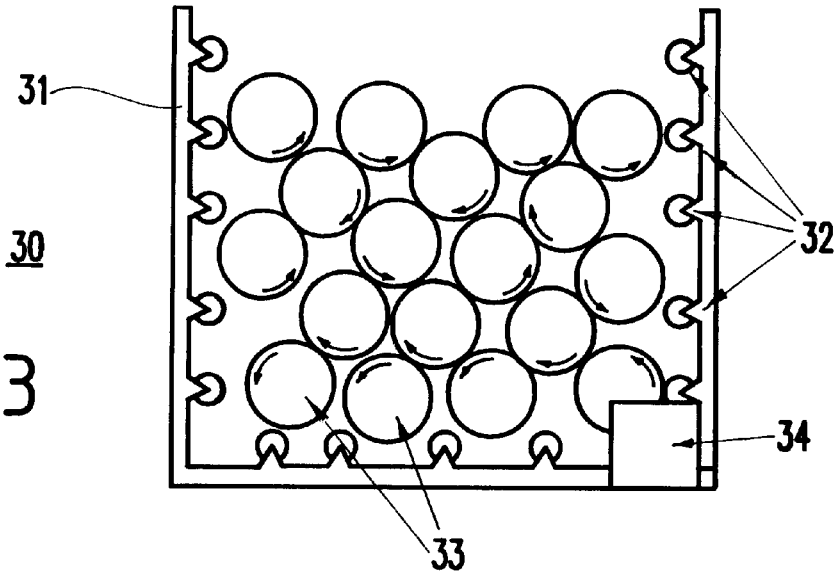
FIG. 3 is a schematic diagram of a multi-can roller rack.

FIG. 3 illustrates a second embodiment of the present invention in which a structure 30 includes a housing/frame 31 (e.g., preferably having a generally square or rectangular shape) including a plurality of passive rollers 32. A plurality of containers 33 are accommodated in the housing stacked in an offset manner with regard to one another. The containers 33 are rotated by a clockwork drive 34 driving at least one drive roller and more preferably by driving a plurality of drive rollers. It is noted that the drive roller may be driven by a chain drive, a belt drive, or the like.

The plurality of passive rollers allow one clockwork 34 to turn an arbitrarily large number of cans or jars which are stacked in a pyramid or alternating-offset rows. Vertical roller bars would allow efficient packing of shelf space since a rectangular or square shape packing would handle more containers as compared to a pyramid-shaped arrangement, thereby allowing great benefit to stock shelves in warehouses, retail establishments, etc.

Figure 4:
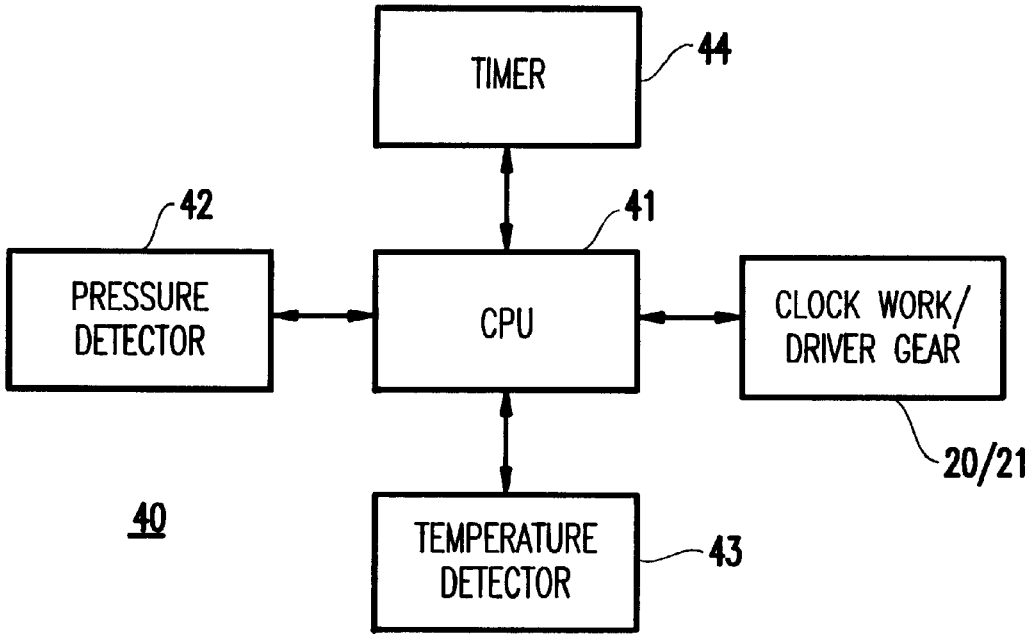
FIG. 4 illustrates a control system for use with the present invention.

Turning to FIG. 4, a control system 40 is shown for rotating (e.g., preferably constantly) the container based on any one or more of changes in temperature, atmospheric pressure, time, etc. As shown, the system includes a central processing unit (CPU) 41 for receiving inputs from a pressure detector 42, a temperature detector 43, and/or a timer 44. Based on such input(s), the CPU 41 outputs a signal to the clockwork 20/drive gear 21 to rotate the container. It is noted that the rate and direction of rotation may be selectively changed or alternated by the CPU 41 so that better agitation results. Further, the rotation speed, direction, etc. could be pre-programmed in the CPU 41. Thus, a periodic rotation, direction and rate can be employed.

Further, the timer 44 may be provided to prompt the CPU to output control signals to the clockwork 20/drive gear 21 as appropriate. It is noted that while the timer 44 is shown externally to the CPU, the timer 44 could be provided internally to the CPU. The timer may be reset by the CPU 41.

Thus, the present invention provides a structure for rotating a container which acts like a cement mixer, re-blending the mixture's constituents stored in the container, and keeping them blended.

While the invention has been described in terms of preferred embodiments, those skilled in the art will recognize that the invention can be practiced with modification within the spirit and scope of the appended claims.

Figure 5:
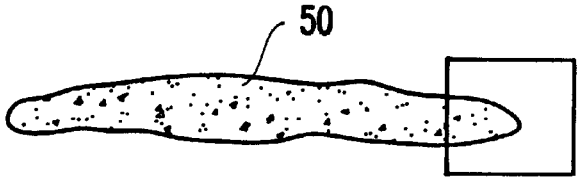
FIG. 5 illustrates a chain for cogged belt for heavy weight, slippery containers.

For example, as shown in FIG. 5, the drive roller may be driven by a chain drive or a cogged belt drive 50 attached to the clockwork (not referenced) for heavy-weight, slippery containers (e.g., cans).

Further, the rotation and rate may be selectively changed and pre-programmed in the CPU. Thus, the drive roller may be programmed to rotate a container (e.g., champagne bottle) a predetermined amount (e.g., a quarter turn) followed by a time period until a next rotation by the predetermined amount. Thus, changes in rotation, direction, rate, periodicity (e.g., ON/OFF time), etc. can be suitably selected. In the most basic arrangement, the rotation is continuous.

Figure 6A:
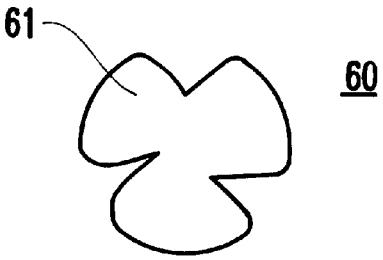
FIGS. 6A–6B illustrate various agitator inserts for use with the present invention.
Figure 6B:
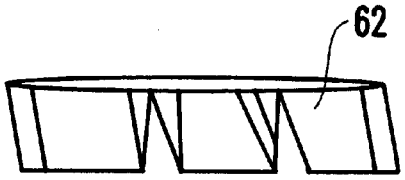

Additionally, as shown in FIGS. 6A-6B, the containers may be designed to have various agitators tabs formed integrally therein. That is, a can 60 may be formed to have an integral agitator tab 61 built therein, as shown in FIG. 6A. Alternatively, the can itself could be built to have an irregular shape (e.g., such as the shape of tab 61) to promote agitation.

Further, as shown in FIG. 6B, agitator inserts 62 having an accordion-like shape or the like may be designed to be folded and inserted into the containers to assist in mixing/agitating the contents therein.

Additionally, a cylindrical packing adapter for receiving non-cylindrical-shaped containers (e.g., rectangular shaped juice boxes) can be provided to further enhance the utility of the invention.

The present invention can be advantageously used with existing systems such as a system including conveyor wheels.

Figure 7:
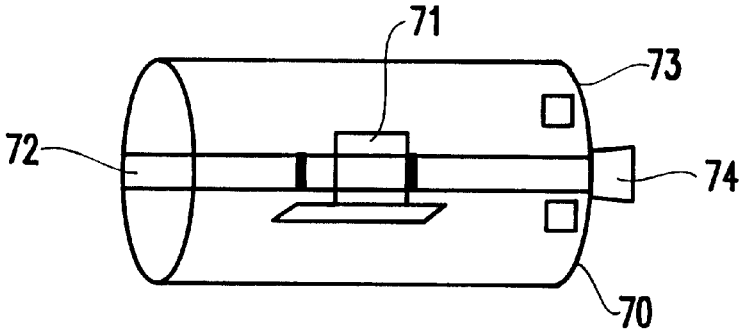
FIG. 7 illustrates a container being turned directly by a clockwork.

Further, as shown in FIG. 7, a container may be turned directly by the clockwork as opposed to turning the driver roller. As shown in FIG. 7, in a container 70, a clockwork 71 is included therein attached to a fixed shaft 72. The lid 73 of the container is preferably magnetic or has a magnet 74 placed thereon. For example, such an arrangement would be useful for a paint can in which the paint can is allowed to roll across a floor to agitate/mix the paint therein.

Such a system can be used with a shelf with a lip. In the case of a removable magnet, once one end is reached, then the magnet is placed on the opposite end of the can to roll the can in an opposite direction.

What is claimed is:

1. A system for storing a container containing a mixture therein having blended constituents, comprising:

a frame, a drive roller mounted on said frame driven by a drive medium;

a passive roller mounted on said frame, a container being received on an outer periphery of said drive roller and said passive roller, and a control system for selectively controlling a rotation of said container, wherein said drive roller rotates said container such that said mixture held in said container is maintained blended, and wherein said control system includes a temperature sensor, said control system selectively controlling said rotation based on an output of said temperature sensor.

2. The system according to claim 1, wherein said drive unit comprises a clockwork gearing mechanism for driving said drive roller.

3. The system according to claim 1, wherein said frame, said passive roller, and said drive roller are each extendable to predetermined lengths.

4. The system according to claim 1, wherein said drive roller and said passive roller each include a grip coating on outer peripheries thereof.

5. The system according to claim 1, wherein a plurality of passive rollers are provided.

6. The system according to claim 1, wherein said drive roller continuously rotates said container.

7. The system according to claim 1, wherein said drive roller comprises one of a chain drive roller and a cogged belt drive roller.

8. The system according to claim 1, wherein at least one of said drive roller and said passive roller includes one of a rubber and elastomer material for gripping said container.

9. A system for storing a container containing a mixture therein having blended constituents, comprising:

a frame;

a drive roller mounted on said frame driven by a drive medium;

a passive roller mounted on said frame, a container being received on an outer periphery of said drive roller and said passive roller, and a control system for selectively controlling a rotation of said container, wherein said drive roller rotates said container such that said mixture held in said container is maintained blended, and wherein said control system includes an atmospheric pressure sensor, said control system selectively controlling said rotation based on an output of said atmospheric pressure sensor.

10. The system according to claim 9, wherein a plurality of passive rollers are provided.

* * * * *